United States Patent [19]

Tieszen et al.

[11] 4,098,776

[45] Jul. 4, 1978

[54] POLY(ARYLENE SULFIDE) FIBERS

[75] Inventors: Dale O. Tieszen; Oren L. Marrs, both of Bartlesville, Okla.

[73] Assignee: Phillips Petroleum Company, Bartlesville, Okla.

[21] Appl. No.: 691,120

[22] Filed: May 28, 1976

[51] Int. Cl.[2] ..... C08F 28/00

[52] U.S. Cl. ..... 528/481; 57/140 R; 57/157 R; 66/169 R; 528/503; 528/373

[58] Field of Search ..... 260/79, 79.1; 57/140 R, 57/157 R; 66/169; 139/383 R

[56] References Cited

U.S. PATENT DOCUMENTS

| | | | |
|---|---|---|---|
| 3,562,199 | 2/1971 | Hill, Jr. et al. | 260/37 |
| 3,793,256 | 2/1974 | Scoggin | 260/79 |
| 3,912,695 | 10/1975 | Short et al. | 260/79 |

*Primary Examiner*—Melvyn I. Marquis

[57] ABSTRACT

Tenacity and boiling water shrinkage of poly(arlene sulfide) fibers are improved by a heat treatment at temperatures of at least about 100° C (212° F) but below the temperature at which fibers begin to stick to each other, for a time period sufficient to attain desired tenacity or boiling water shrinkage.

11 Claims, No Drawings

POLY(ARYLENE SULFIDE) FIBERS

BACKGROUND OF THE INVENTION

This invention relates to poly(arylene sulfide) fibers. In particular it relates to heat treating poly(arylene sulfide) fibers to improve boiling water shrinkage and tenacity thereof.

Poly(arylene sulfide) polymers can be melt spun into fibers which possess high melting points and are non-burning non-corrosive and highly resistant to most chemicals including commonly used acids and bases. The fibers can be formed into yarn from which fabrics can be made by knitting, weaving or other means including means for producing non-woven fabrics. As the result of these properties, articles made out of poly(arylene sulfides) are useful in many industrial and hazardous applications. The range of possible applications of such fibers produced in accordance wih the disclosures of U.S. Pat. Nos. 3,895,091 and 3,912,695, for example, is increased by increasing the tenacity and reducing the boiling water shrinkage by this invention. For example, the boiling water shrinkage of conventional poly(phenylene sulfide) fibers, several times higher than the shrinkage of fabrics made of cotton fibers, is improved 80–95% and tenacity of these fibers is improved 15–20%.

This invention provides a method for improving tenacity and boiling water shrinkage properties of poly(arylene sulfide) fibers and articles made therefrom.

Thus, one object of the invention is to increase the spectrum of possible applications of poly(arylene sulfide) fibers and objects made therefrom.

Another object of the invention is to improve boiling water shrinkage and tenacity of poly(phenylene sulfide) fibers and articles made therefrom.

A further object of the invention is to provide a quick, efficient and simple method for treating poly(arylene sulfide) fibers to improve boiling water shrinkage and tenacity thereof.

Still further objects will become apparent to those skilled in the art upon studying this disclosure.

SUMMARY OF THE INVENTION

In accordance with one aspect of the invention poly(arylene sulfide) fibers are subjected to heat treatment at a temperature of at least about 100° C (212° F), but below the temperature at which fibers become sticky, for a time period sufficient to result in desired improvement of fibers tenacity and/or boiling water shrinkage.

In accordance with another aspect of the invention poly(phenylene sulfide) articles are subjected to temperatures of at least about 125° C (257° F), but below the temperature at which fibers begin to stick to each other for at least 15 minutes in order to improve the articles' tenacity and boiling water shrinkage.

Other aspects of the invention will become apparent to those skilled in the art upon studying this disclosure.

DETAILED DESCRIPTION OF THE INVENTION

Surprisingly, it has been discovered that when spun poly(arylene sulfide) fibers, or the articles made from yarn into which fibers are formed, are subjected to heat treatment at temperatures of at least 125° C (257° F), but below the temperature at which fibers become sticky, for at least about 15 minutes, the tenacity and the boiling water shrinkage of fibers or articles is drastically improved. Although some improvement is observed at lower temperatures, it is believed that a temperature of slightly above 100° C is required in order to reduce, within a commercially reasonable period of time, boiling water shrinkage to the point when it is comparable with that of cotton fabrics (about 1%). The maximum treatment temperature is the temperature at which fibers become sticky. The time of exposure to heat treatment varies upon the ultimate properties desired, the type of poly(arylene sulfide) and the temperature of the treatment. In general, the higher the temperature, the desired boiling water shrinkage and tenacity properties are achieved in a shorter period of time. To reduce boiling water shrinkage of poly(phenylene sulfide) fiber to that of cotton, the fibers can be heated for a time period of between 60 minutes and 15 minutes when the temperatures are 125° C (257° F), and 200° C (392° F), respectively. Of course, lower temperatures can be used if the treatment time is increased. It should be emphasized, however that at a temperature of about 100° C (212° F) only negligible improvement is attained by prolonged heating; it is, therefore, believed that the minimum practicable temperature of treatment to obtain boiling water shrinkage equal or below that of cotton (about 1%) is somewhat above 100° C (212° F) but below 125° C (257° F). The heat treatment is carried out preferably in oxidizing, but it also can be carried out in inert atmosphere.

The fibers and articles made therefrom, which are suitable for the use with this invention include those made of poly(arylene sulfide). Fibers of particular interest are those which are melt spun from poly(arylene sulfide). Especially useful are those fibers that are spun from poly(phenylene sulfide) resin, which is made in the presence of basic alkali metal carboxylates such as lithium or sodium acetate in accordance with the process disclosed in U.S. Pat. No. 3,919,177.

In operation, poly(phenylene sulfide) spun fibers or articles made therefrom are placed in a circulating forced draft oven in air. In the oven the fibers or articles are exposed to heat treatment at temperatures described above, for a time period necessary to achieve desired improvement in boiling water shrinkage and/or in tenacity. The fibers or articles are then removed from the oven and upon cooling are ready for the desired use.

The following Examples are included merely for illustrative purposes; these are not intended to limit the scope of the invention in any manner.

EXAMPLE I

The poly(phenylene sulfide), fiber grade, was prepared by the use of p-dichlorobenzene, sodium sulfide, N-methylpyrrolidone and lithium acetate in accordance with the method of U.S. Pat. No. 3,919,177. Two batches were made and blended to provide the material used to form the fibers. The selected properties of the two batches and those of the blend are shown on Table I; the blend had an ash content of 0.35 wt. %.

TABLE I

PROPERTIES OF POLY(PHENYLENE SULFIDE)

| Batch | Inherent Viscosity* | Melt Flow (ASTM-D-1238-70, at 350° C under 5 kg load) |
|---|---|---|
| 1 | 0.34 | 116 |
| 2 | 0.30 | 161 |
| Blend of 1 & 2 | 0.28 | 151 |

*Measured in 1-chloronapthalene at 206° C, 0.4g polymer/100 ml. solution.

Spinning of the Fiber

The resin prepared above was spun into a number of fiber samples using a screw driven extruder fitted with a spinneret containing 34 capillary holes of 0.009 inch diameter and 0.12 inch length. The assembly used a sand screen pack using 6cc of 60/80 mesh sand at the bottom, the remainder being 20/40 mesh. The spin pack was fitted with 325, 150, and 100 mesh screens in the lower section, and 150 mesh screens in the upper section.

The polymer was extruded at 300°-310° C (572°-590° F) at a rate of 11-12 g/minute. The fiber was drawn at a draw ratio of 3.9 at 100° C (212° F) at about 30 ft/minute rate. The fibers were then wound up onto spools.

Heat Treatment

The wound-up spools of fibers were placed in a circulating forced draft oven in air and subjected to heat treatment of varying periods of time and different temperatures. The data displayed in Table II give the elongation, tenacity, and % boiling water shrinkage before and after treatment for several runs. Tenacity and elongation were determined using ASTM-D-2256-69 and boiling water shrinkage (BWS) was determined by ASTM-D-2259-64T.

TABLE II

| | Before Treatment | | | | Treatment | | After Treatment | | |
|---|---|---|---|---|---|---|---|---|---|
| Sample # | Denier | Tenacity[1] | Elongation % | BWS % | Temp. ° C | Time, Min. | Tenacity | Elongation % | BWS % |
| 1 | 195 | 2.7 | 19 | 15.3 | 200 | 15 | 3.4 | 16 | 1.0 |
| 2 | 197 | 2.9 | 22 | 19.4 | 200 | 30 | 3.5 | 18 | 0.6 |
| 3 | 194 | 2.8 | 17 | 15.8 | 200 | 60 | 3.6 | 18 | 0.4 |
| 4 | 197 | 2.9 | 16 | 13.1 | 200 | 180 | 3.5 | 18 | 0.3 |
| 5 | 192 | 3.0 | 15 | 12.8 | 150 | 15 | 3.4 | 17 | 1.5 |
| 6 | 190 | 2.9 | 15 | 13.7 | 150 | 30 | 3.6 | 16 | 1.5 |
| 7 | 197 | 2.7 | 17 | 13.4 | 150 | 60 | 3.3 | 18 | 0.6 |
| 8 | 195 | 2.8 | 17 | 15.4 | 150 | 180 | 3.4 | 17 | 0.4 |
| 9 | 190 | 3.0 | 20 | 16.6 | 125 | 30 | 3.5 | 19 | 1.2 |
| 10 | 194 | 3.0 | 20 | 18.8 | 125 | 60 | 3.3 | 18 | 1.1 |
| 11 | 194 | 2.9 | 20 | 19.2 | 125 | 120 | 3.4 | 18 | 0.3 |
| 12 | 197 | 2.9 | 19 | 17.2 | 125 | 180 | 3.2 | 19 | 0.3 |
| 13 | 197 | 2.8 | 18 | 18.8 | 100 | 30 | 2.8 | 19 | 6.9 |
| 14 | 199 | 2.9 | 19 | 16.8 | 100 | 60 | 2.9 | 18 | 5.8 |
| 15 | 192 | 2.6 | 18 | 17.7 | 100 | 120 | 3.1 | 20 | 4.6 |
| 16 | 196 | 2.9 | 18 | 17.2 | 100 | 180 | 3.0 | 19 | 4.5 |

[1]grams/denier

From the data, it can be concluded that tenacity and boiling water shrinkage improvement depends on the temperature and time period of the treatment. At 100° C (212° F) the treatment, even when carried out for 180 minutes, does not lead to a significant improvement of tenacity; boiling water shrinkage (BWS) is significantly improved even at this temperature. As the temperature and time period of the treatment increases, the tenacity values increase and BWS values decrease. At temperatures of 125° C (257° F) and above the treatment time of about one hour or less is sufficient to reduce BWS to about 1% which is an acceptable level as cotton fabrics which are sanforized have shrinkage of that magnitude. It should be emphasized that tenacity is improved by the treatment by as much as 25% and BWS is improved by as much as 90%.

I claim:

1. A method for improving tenacity and boiling water shrinkage of poly(arylene sulfide) fibers and articles made therefrom which comprises:

subjecting spun poly(arylene sulfide) fibers or articles to temperatures of at least about 100° C (212° F), but less than the temperature at which fibers stick to each other, for a time period sufficient to increase the tenacity and decrease the boiling water shrinkage.

2. A method of claim 1 wherein the boiling water shrinkage is decreased to below about 1% by subjecting spun fibers or articles to a temperature greater than 100° C (212° F), but less than the temperature at which fibers stick to each other, in an oxidizing atmosphere for a time period sufficient to achieve said improvement.

3. A method of claim 2 wherein spun fibers are subjected to a temperature of at least about 125° C (257° F) for at least one hour.

4. A method of claim 2 wherein spun fibers are subjected to a temperature in the range of from about 125° C (257° F) to about 200° C (392° F) for a period of time ranging from about 1 hour to about ¼ of an hour, respectively.

5. A method of claim 1 wherein said poly(arylene sulfide) fibers are poly(phenylene sulfide).

6. A method of claim 2 wherein said poly(arylene sulfide) fibers are poly(phenylene sulfide) and the heat treatment is carried out in the presence of air.

7. A method of claim 3 wherein said poly(arylene sulfide) fibers are poly(phenylene sulfide) and the heat treatment is carried out in the presence of air.

8. A method of claim 4 wherein said poly(arylene sulfide) fibers are poly(phenylene sulfide) and the heat treatment is carried out in the presence of air.

9. An article of manufacture comprising a yarn or fabric formed of melt-spun poly(arylene sulfide) treated as in claim 1.

10. An article of manufacture claimed in claim 9 wherein poly(arylene sulfide) is poly(phenylene sulfide).

11. An article of manufacture claimed in claim 10 wherein the boiling water shrinkage thereof is below about 1% following a heat treatment at temperatures ranging from about 125° C (257° F) to about 200° C (392° F) for a time period from about 1 hour to about ¼ of an hour, respectively.

* * * * *